US012564303B2

(12) United States Patent
Hou

(10) Patent No.: US 12,564,303 B2
(45) Date of Patent: Mar. 3, 2026

(54) OBSTACLE RECOGNITION METHOD AND APPARATUS, MEDIUM AND ELECTRONIC DEVICE

(71) Applicant: Beijing Roborock Innovation Technology Co., Ltd., Beijing (CN)

(72) Inventor: Zhengtao Hou, Beijing (CN)

(73) Assignee: Beijing Roborock Innovation Technology Co., Ltd., Beijing (CN)

( * ) Notice: Subject to any disclaimer, the term of this patent is extended or adjusted under 35 U.S.C. 154(b) by 261 days.

(21) Appl. No.: 18/252,035

(22) PCT Filed: Jun. 17, 2021

(86) PCT No.: PCT/CN2021/100714
§ 371 (c)(1),
(2) Date: May 6, 2023

(87) PCT Pub. No.: WO2022/095453
PCT Pub. Date: May 12, 2022

(65) Prior Publication Data

US 2024/0008705 A1 Jan. 11, 2024

(30) Foreign Application Priority Data

Nov. 6, 2020 (CN) ..... 202011228693.1

(51) Int. Cl.
*A47L 11/40* (2006.01)

(52) U.S. Cl.
CPC ..... *A47L 11/4061* (2013.01); *A47L 2201/04* (2013.01)

(58) Field of Classification Search
CPC ..... A47L 11/4061; A47L 2201/04; A47L 9/2852; A47L 11/24; A47L 9/2805;
(Continued)

(56) References Cited

U.S. PATENT DOCUMENTS 5,416,713 A * 5/1995 Kameda ..... G05D 1/106 701/410
5,592,215 A * 1/1997 Kuga ..... G02B 30/26 348/51

(Continued)

FOREIGN PATENT DOCUMENTS

CN 108445878 A 8/2018
CN 109255341 A 1/2019

(Continued)

OTHER PUBLICATIONS

Extended European Search Report of Patent Application No. 21888156.3 dated Jul. 23, 2024.

(Continued)

*Primary Examiner* — Bhavesh V Amin
(74) *Attorney, Agent, or Firm* — Calfee, Halter & Griswold LLP

(57) ABSTRACT

A method for identifying an obstacle, including: acquiring current identification feature information of the obstacle; bypassing to a position around the obstacle in response to determining that the current identification feature information does not satisfy an identification condition, and acquiring identification feature information of the obstacle at the position correspondingly; and determining a target type of the obstacle based on all identification feature information of the obstacle.

18 Claims, 4 Drawing Sheets

(58) Field of Classification Search
CPC .... A47L 23/205; A47L 11/4011; A47L 11/40; G05D 2105/10; G05D 2107/40; G05D 2109/10; G05D 2111/10; G05D 1/243; G05D 1/246; G05D 1/6445; G05D 1/689; G06V 20/58; G06V 10/764; G06T 7/70
See application file for complete search history.

(56) References Cited

U.S. PATENT DOCUMENTS 5,612,883 A * 3/1997 Shaffer ..... G05D 1/0278 702/159
5,633,995 A * 5/1997 McClain ..... G06T 15/10 345/419
6,272,237 B1 * 8/2001 Hashima ..... B25J 9/1697 348/113
6,816,109 B1 * 11/2004 Schwartz ..... G01S 13/524 382/281
7,386,163 B2 * 6/2008 Sabe ..... G06V 20/10 348/42
7,539,563 B2 * 5/2009 Yang ..... G06T 7/70 701/450
7,583,817 B2 * 9/2009 Kimura ..... G06V 20/58 382/104
7,769,491 B2 * 8/2010 Fukuchi ..... G05D 1/0251 701/1
7,853,372 B2 * 12/2010 Park ..... G05D 1/0272 382/103
7,912,633 B1 * 3/2011 Dietsch ..... G05D 1/0274 701/450
8,103,383 B2 * 1/2012 Nakamura ..... G05D 1/0214 700/250
8,204,679 B2 * 6/2012 Nakamura ..... B62D 57/032 901/1
8,442,321 B1 * 5/2013 Chang ..... G06V 10/454 382/199
8,553,088 B2 * 10/2013 Stein ..... B60Q 1/1423 382/104
8,655,588 B2 * 2/2014 Wong ..... G01S 17/89 701/500
8,688,275 B1 * 4/2014 LaFary ..... G05D 1/024 700/254
8,706,298 B2 * 4/2014 Goulding ..... G06N 3/008 700/251
8,799,201 B2 * 8/2014 James ..... G06V 10/255 706/45
8,825,387 B2 * 9/2014 Mays ..... G01C 21/3423 701/434
8,873,831 B2 * 10/2014 Ahn ..... G05D 1/0272 382/153
9,402,518 B2 * 8/2016 Burlutskiy ..... A47L 11/4011
9,697,439 B2 * 7/2017 Gaidon ..... G06V 10/758
9,953,540 B2 * 4/2018 Macfarlane ..... G01C 21/3867
10,108,200 B2 * 10/2018 Etoh ..... G05D 1/0246
10,111,566 B2 * 10/2018 Ahn ..... A47L 9/2826
10,242,455 B2 * 3/2019 Harmsen ..... G06T 7/579
10,272,828 B2 * 4/2019 White ..... A47L 9/2826
10,274,958 B2 * 4/2019 DelMarco ..... G01C 21/005
10,386,188 B2 * 8/2019 Tian ..... G01S 17/86
10,452,071 B1 * 10/2019 Ebrahimi Afrouzi .. G06V 20/58
10,514,708 B2 * 12/2019 Cheng ..... G05D 1/106
10,542,859 B2 * 1/2020 Lee ..... A47L 9/2826
10,624,517 B2 * 4/2020 Jung ..... A47L 11/16
10,638,906 B2 * 5/2020 Herron ..... G05D 1/024
10,713,961 B2 * 7/2020 Priest ..... G08G 5/34
10,750,918 B2 * 8/2020 Jung ..... A47L 9/2852
10,852,729 B2 * 12/2020 Choi ..... G05D 1/0274
10,929,664 B2 * 2/2021 King ..... H04W 4/80
11,222,207 B2 * 1/2022 Hu ..... G05D 1/0219
11,281,229 B2 * 3/2022 Cheng ..... G05D 1/0246
11,287,828 B2 * 3/2022 Bai ..... G06T 7/20
11,429,117 B2 * 8/2022 Cai ..... B64U 10/13
11,641,994 B2 * 5/2023 Shin ..... A47L 9/2852 15/319
11,662,723 B2 * 5/2023 Schlacks, IV ..... G05D 1/247 700/245
11,672,391 B2 * 6/2023 Kim ..... A47L 9/2805 15/319
11,694,333 B1 * 7/2023 Knuffman ..... G06V 10/454 382/154
11,874,668 B2 * 1/2024 Song ..... A47L 9/2852
11,960,282 B2 * 4/2024 Cole ..... G05D 1/646
12,001,517 B2 * 6/2024 Zhang ..... G06V 30/19107
12,065,164 B2 * 8/2024 Player ..... G06V 20/58
12,096,908 B2 * 9/2024 Wang ..... G05D 1/628
12,117,840 B1 * 10/2024 Ebrahimi Afrouzi ..... A47L 11/4061
12,161,284 B2 * 12/2024 Kumar ..... A47L 11/201
12,233,555 B2 * 2/2025 Hong ..... G05D 1/0248
12,253,852 B2 * 3/2025 al-Mohssen ..... A47L 9/2805
2005/0131581 A1 * 6/2005 Sabe ..... G05D 1/0251 700/245
2005/0182518 A1 * 8/2005 Karlsson ..... G06V 10/84 700/253
2006/0072818 A1 * 4/2006 Herley ..... G06T 7/12 382/173
2007/0061043 A1 * 3/2007 Ermakov ..... G05D 1/0274 700/263
2007/0090973 A1 * 4/2007 Karlsson ..... G05D 1/0246 340/995.22
2007/0150097 A1 * 6/2007 Chae ..... G05D 1/0234 700/245
2008/0201014 A1 * 8/2008 Sonoura ..... G05D 1/028 700/250
2009/0048727 A1 * 2/2009 Hong ..... G05D 1/0238 701/26
2010/0222925 A1 * 9/2010 Anezaki ..... G05D 1/0221 700/253
2013/0206177 A1 * 8/2013 Burlutskiy ..... A47L 9/009 15/319
2015/0032259 A1 * 1/2015 Kim ..... A47L 9/2805 700/255
2016/0278599 A1 * 9/2016 Seo ..... G05D 1/0022
2016/0353959 A1 * 12/2016 Lindhé ..... A47L 11/24
2016/0371984 A1 * 12/2016 Macfarlane ..... G05D 1/106
2017/0090456 A1 * 3/2017 Mao ..... G05D 1/0246
2017/0203446 A1 * 7/2017 Dooley ..... H04N 23/631
2017/0215672 A1 * 8/2017 Watanabe ..... A47L 9/2894
2017/0329335 A1 * 11/2017 DelMarco ..... G05D 1/02
2017/0358228 A1 * 12/2017 Priest ..... G06V 20/17
2018/0113234 A1 * 4/2018 Ye ..... G06T 7/521
2018/0149479 A1 * 5/2018 Tian ..... G05D 1/0202
2018/0210445 A1 * 7/2018 Choi ..... G05D 1/0238
2018/0210452 A1 * 7/2018 Shin ..... A47L 9/2805
2018/0213994 A1 * 8/2018 Lee ..... A47L 9/2852
2018/0249872 A1 * 9/2018 Park ..... G06T 7/74
2018/0289225 A1 * 10/2018 Izawa ..... G06T 1/00
2018/0299899 A1 * 10/2018 Suvarna ..... A47L 9/2805
2018/0348783 A1 * 12/2018 Pitzer ..... G05D 1/0214
2018/0353042 A1 * 12/2018 Gil ..... A47L 11/4044
2019/0019069 A1 * 1/2019 Qian ..... G06F 3/04845
2019/0025838 A1 * 1/2019 Artes ..... G05D 1/0246
2019/0025850 A1 * 1/2019 Park ..... A47L 9/2852
2019/0179332 A1 * 6/2019 Cheng ..... G06V 10/255
2019/0204847 A1 * 7/2019 Noh ..... A47L 9/2842
2019/0213438 A1 * 7/2019 Jones ..... G06V 20/10
2019/0298134 A1 * 10/2019 Takaoka ..... A47L 9/2852
2019/0303668 A1 * 10/2019 King ..... H04W 4/80
2019/0320867 A1 * 10/2019 Noh ..... B25J 9/16
2019/0332119 A1 * 10/2019 Kim ..... G05D 1/0248
2019/0362640 A1 * 11/2019 Wu ..... G08G 5/55
2019/0385322 A1 * 12/2019 Gu ..... G06T 7/55
2020/0008639 A1 * 1/2020 Lee ..... G06V 20/10
2020/0012292 A1 * 1/2020 Park ..... B25J 19/023
2020/0066142 A1 * 2/2020 Fowe ..... G06V 20/54
2020/0069125 A1 * 3/2020 Gritsenko ..... A47L 9/009
2020/0072610 A1 * 3/2020 Hofmann ..... G06V 20/176
2020/0082181 A1 * 3/2020 Li ..... G06T 11/20
2020/0104598 A1 * 4/2020 Qian ..... G06V 20/20
2020/0135035 A1 * 4/2020 Yuan ..... G08G 5/26
2020/0150692 A1 * 5/2020 Cai ..... G05D 1/101
2020/0152692 A1 5/2020 Liao

(56) References Cited

U.S. PATENT DOCUMENTS

2020/0218274 A1* 7/2020 Lee ..... A47L 9/2826
2020/0225673 A1* 7/2020 Ebrahimi Afrouzi ..... A47L 11/4011
2020/0331148 A1* 10/2020 Zhang ..... A47L 11/4011
2020/0363212 A1* 11/2020 Suzuki ..... G01C 21/38
2021/0007572 A1* 1/2021 Sim ..... G05D 1/0274
2021/0026367 A1* 1/2021 Yang ..... G05D 1/0227
2021/0034061 A1* 2/2021 Yun ..... A47L 11/4038
2021/0064055 A1* 3/2021 Jun ..... A47L 9/2852
2021/0114220 A1* 4/2021 Shin ..... A47L 9/2852
2021/0121032 A1* 4/2021 Kim ..... A47L 9/2805
2021/0124354 A1* 4/2021 Munich ..... G05D 1/0212
2021/0138640 A1* 5/2021 Choi ..... B25J 9/163
2021/0142061 A1* 5/2021 Shin ..... G06F 18/25
2021/0182579 A1* 6/2021 Cui ..... G06N 20/00
2021/0212541 A1* 7/2021 Sung ..... A47L 9/2826
2021/0213619 A1* 7/2021 Hong ..... A47L 9/2894
2021/0244252 A1* 8/2021 Kim ..... G05D 1/0221
2022/0061616 A1* 3/2022 Yoon ..... G01S 17/89
2022/0125255 A1* 4/2022 Choi ..... A47L 9/2826
2022/0133112 A1* 5/2022 Windorfer ..... A47L 9/2894 15/319
2022/0229434 A1* 7/2022 al-Mohssen ..... G05D 1/0038
2023/0091839 A1* 3/2023 Kim ..... G05D 1/0246 700/245
2023/0157507 A1* 5/2023 Wu ..... A47L 9/2857 15/319
2023/0200611 A1* 6/2023 Kim ..... A47L 9/009 700/253
2023/0200613 A1* 6/2023 Niu ..... A47L 11/4011 701/301
2023/0225576 A1 7/2023 Wu et al.
2023/0320551 A1* 10/2023 Orzechowski ..... G06V 10/56 701/28
2023/0341551 A1* 10/2023 Wang ..... G06V 10/143
2023/0404345 A1* 12/2023 Lim ..... B25J 9/0003
2024/0119614 A1* 4/2024 Ebrahimi Afrouzi ..... A47L 11/4011
2024/0119630 A1* 4/2024 Ye ..... A47L 11/4008
2024/0393788 A1* 11/2024 Hong ..... G01S 17/931
2024/0419187 A1* 12/2024 Sun ..... G06N 3/0464
2025/0072693 A1* 3/2025 Jasper ..... A47L 11/4036
2025/0306604 A1* 10/2025 Zou ..... A47L 11/24

FOREIGN PATENT DOCUMENTS

CN 109645892 A 4/2019
CN 109857112 A 6/2019
CN 109890574 A 6/2019
CN 109947109 A 6/2019
CN 110315538 A 10/2019
CN 110522359 A 12/2019
CN 110622085 A 12/2019
CN 110968083 A 4/2020
CN 111481105 A 8/2020
CN 112380942 A 2/2021

OTHER PUBLICATIONS

Office action from Chinese Application No. 202011228693.1 dated Aug. 30, 2023.
International Search Report from PCT/CN2021/100714 dated Sep. 15, 2021.
First Office Action of EP application No. 21888156.3 dated May 30, 2025.
Research titled Next Best View Planning for Object Recognition in Mobile Robotics dated Jan. 16, 2017.

* cited by examiner

OBSTACLE RECOGNITION METHOD AND APPARATUS, MEDIUM AND ELECTRONIC DEVICE

CROSS-REFERENCE TO RELATED APPLICATION

This application is a US national phase of a PCT application under PCT/CN2021/100714, which claims priority of the Chinese Patent Application No. 202011228693.1, filed on Nov. 6, 2020, which is incorporated herein by reference in its entirety.

TECHNICAL FIELD

The present disclosure relates to the field of robots, and in particular to a method and apparatus for identifying an obstacle, a medium and an electronic device.

BACKGROUND

A walking robot feeds ground conditions back to a computer through a sensor or a camera, the computer makes a judgment based on the ground conditions, and then the walking robot stably walks forwards, backwards, leftwards or rightwards. For example, a sweeping robot, also known as an automatic cleaning robot, a smart vacuum cleaner, a robot vacuum cleaner or the like, is a smart home device capable of automatically cleaning the ground, and can complete sweeping the floor in a room automatically by virtue of artificial intelligence.

At present, the walking robot has very limited ability to identify obstacles through the camera, and often misidentifies or fails to identify some obstacles (such as pet feces) due to their different shapes. If the sweeping robot misidentifies the pet feces, there will be a large area not swept; and if the sweeping robot fails to identify the pet feces, the pet feces may be smeared to clean regions, resulting in extremely poor user experience.

SUMMARY

This section of Summary is provided to introduce the concepts in a simplified form that are described in detail in the section of Detailed Description. This section of Summary is not intended to define key features or essential features of the claimed technical solutions, nor is it intended to be used to limit the scope of the claimed technical solutions.

The present disclosure aims to provide a method and apparatus for identifying an obstacle, a medium and an electronic device, which can solve at least one of the technical problems mentioned above. Specific solutions are as follows.

According to specific embodiments of the present disclosure, in a first aspect, the present disclosure provides a method for identifying an obstacle, including:

acquiring current identification feature information of the obstacle in a process of identifying the obstacle;

bypassing to at least one position around the obstacle when the current identification feature information does not satisfy an identification condition, and acquiring identification feature information of the obstacle at each position correspondingly; and determining a target type of the obstacle based on all identification feature information of the obstacle.

In some embodiments, the identification feature information at least includes an obstacle type; and bypassing to the at least one position around the obstacle when the current identification feature information does not satisfy the identification condition includes: acquiring a current position of the obstacle; acquiring an marked obstacle type corresponding to the current position by querying an environment map based on the current position; and bypassing to the at least one position around the obstacle when the marked obstacle type does not match with a current obstacle type.

In some embodiments, the identification feature information further includes a confidence value of the obstacle type; and bypassing to the at least one position around the obstacle when the current identification feature information does not satisfy the identification condition includes: bypassing to the at least one position around the obstacle when a confidence value of the current obstacle type is less than a preset confidence threshold.

In some embodiments, determining the target type of the obstacle based on the all identification feature information of the obstacle includes: acquiring a statistical value of each obstacle type by performing classification statistics on all obstacle types of the obstacle; and determining an obstacle type corresponding to a maximum statistical value as the target type.

In some embodiments, determining the target type of the obstacle based on the all identification feature information of the obstacle includes: acquiring a first obstacle type with the confidence value greater than or equal to the preset confidence threshold by screening all confidence values of the obstacle; acquiring a statistical value of each first obstacle type by performing classification statistics on all first obstacle types; and determining a first obstacle type corresponding to a maximum statistical value as the target type.

In some embodiments, after determining the target type of the obstacle, the method further includes: determining the marked obstacle type as misidentification information when the marked obstacle type does not match with the current obstacle type.

In some embodiments, the method further includes: collecting actual region information of the obstacle when the obstacle is bypassed; and after determining the marked obstacle type as the misidentification information, the method further includes: transmitting the target type and the actual region information to the environment map.

According to specific embodiments of the present disclosure, in a second aspect, the present disclosure provides a non-transitory computer-readable storage medium, storing a computer program thereon, where the program, when executed by a processor, implements the method for identifying the obstacle according to any one of the first aspect.

According to specific embodiments of the present disclosure, in a third aspect, the present disclosure provides an electronic device. The electronic device includes: one or more processors; and a storage apparatus configured to store one or more programs, where the one or more programs, when executed by the one or more processors, enables the one or more processors to implement the method for identifying the obstacle according to any one of the first aspect.

BRIEF DESCRIPTION OF THE DRAWINGS

The above and other features, advantages and aspects of various embodiments of the present disclosure will become more apparent with reference to accompanying drawings and the following specific embodiments. The same or similar reference signs indicate the same or similar elements throughout the accompanying drawings. It should be understood that the accompanying drawings are exemplary and the components and elements are not necessarily drawn to scale. In the accompanying drawings.

DETAILED DESCRIPTION

Figure 1:
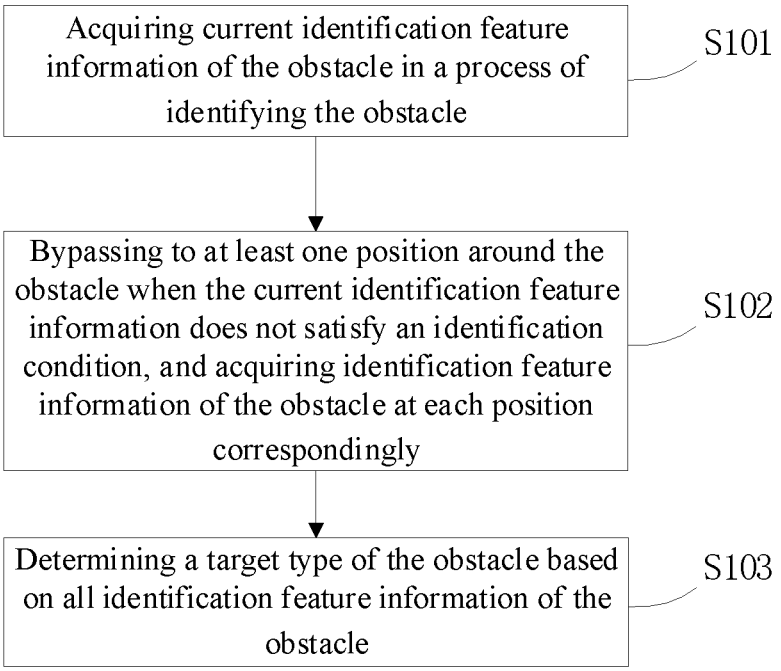
FIG. 1 shows a flowchart of a method for identifying an obstacle according to an embodiment of the present disclosure.

The embodiments of the present disclosure are described in more detail below with reference to the accompanying drawings. Although some embodiments of the present disclosure are shown in the accompanying drawings, it should be understood that the present disclosure may be implemented in various forms and should not be construed as being limited to the embodiments set forth herein. Rather, these embodiments are provided for more thorough and complete understanding of the present disclosure. It should be understood that the accompanying drawings and embodiments of the present disclosure are merely provided for the purpose of illustration, and are not intended to limit the scope of protection of the present disclosure.

It should be understood that various steps described in the method embodiment of the present disclosure may be performed in different orders and/or in parallel. In addition, the method embodiment may include an additional step and/or omit implementation of an illustrated step. The scope of the present disclosure is not limited in this regard.

The term "include" and variations thereof used herein are open-ended inclusions, i.e., "include(s) but are/is not limited to". The term "based on" refers to "at least partially based on". The term "one embodiment" means "at least one embodiment". The term "another embodiment" means "at least one additional embodiment". The term "some embodiments" means "at least some embodiments". Relevant definitions of other terms will be given in the following description.

It should be noted that concepts such as "first" and "second" mentioned in the present disclosure are merely used to distinguish different apparatuses, modules or units, rather than limit an order or interdependence of functions executed by these apparatuses, modules or units.

It should be noted that "a/an" and "a plurality" mentioned in the present disclosure are illustrative and not restrictive, and those skilled in the art should understand that unless otherwise indicated clearly in the context, they should be understood as "one or more".

In the embodiments of the present disclosure, names of messages or information exchanged among a plurality of apparatuses are only for purpose of illustration, and are not intended to limit the scope of these messages or information.

Optional embodiments of the present disclosure are described in detail below with reference to the accompanying drawings.

The present disclosure provides a first embodiment, i.e., an embodiment of a method for identifying an obstacle.

A walking robot (such as a sweeping robot) has limited ability to identify obstacles through a camera, and often misidentifies or fails to identify some obstacles (such as pet feces) due to their different shapes. If the sweeping robot misidentifies the pet feces, there will be a large area not swept; and if the sweeping robot fails to identify the pet feces, the pet feces may be smeared to clean regions. In view of the above problems, an embodiment of the present disclosure provides a method for identifying an obstacle.

The embodiment of the present disclosure will be described in detail below with reference to FIG. 1 and FIG. 2.

Figure 2:
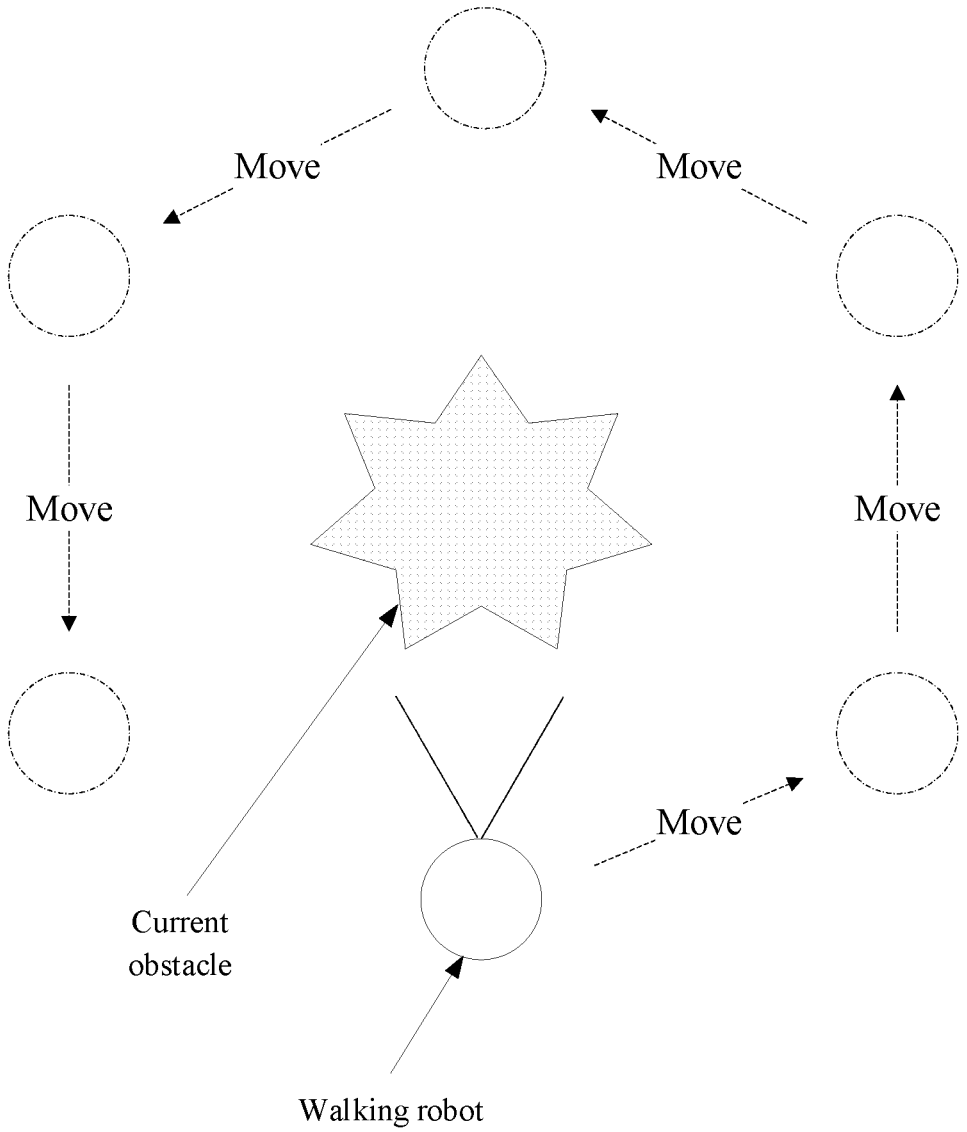
FIG. 2 is a schematic diagram showing that a current obstacle is bypassed in the method for identifying the obstacle according to the embodiment of the present disclosure.

As shown in FIG. 1, in step S101, current identification feature information of the obstacle is acquired in a process of identifying the obstacle.

In the embodiment of the present disclosure, the walking robot collects image information through a camera. When detecting that the obstacle exists within a preset identification range (such as, a range in which the distance from the current obstacle is greater than or equal to 30 cm) during working, the walking robot (such as the sweeping robot) collects information of a current obstacle through the camera and acquires an obstacle type by analyzing the information of the current obstacle.

The identification feature information is a detection result generated by the walking robot based on the information of the current obstacle. The identification feature information includes an obstacle type and a confidence value of the obstacle type. The obstacle type is an identification result for the current obstacle and used to distinguish different obstacles. The obstacle type includes a name of the obstacle. The confidence value is a judgement on the reliability of the acquired obstacle type and usually expressed as a percentage. For example, when the current obstacle is a pot of cactus, the walking robot acquires that the obstacle type is a cactus type and the confidence value is 90% after collecting information of the pot of cactus. However, due to the influences of a shooting angle and a shooting environment, the acquired obstacle type may be a lotus root type and the confidence value is 60%, which may result in misidentification and mis-operations. In the embodiment of the present disclosure, the walking robot is provided with reliability information after judging the current obstacle type through the identification feature information, which prompts the walking robot to further confirm the unreliable obstacle during the walking process, thereby avoiding misidentification and identification failure.

In step S102, bypassing to at least one position around the obstacle is performed when the current identification feature information does not satisfy an identification condition, and identification feature information of the obstacle at each position is correspondingly acquired.

In order to avoid interference of single identification feature information on the identification result, in the embodiment of the present disclosure, when the current identification feature information does not satisfy the identification condition, the walking robot is controlled to acquire the identification feature information of the current obstacle from a plurality of angles and at a plurality of positions around the current obstacle, so as to improve the reliability of the final identification result.

The embodiment of the present disclosure provides two judgment methods for judging whether the current identification feature information satisfies the identification condition or not.

First Judgment Method

Bypassing to the at least one position around the obstacle when the current identification feature information does not satisfy the identification condition includes the following steps.

In step S102-11, a current position of the obstacle is acquired.

The current position may be any position or a plurality of positions where the current obstacle is located.

In step S102-12, a marked obstacle type corresponding to the current position is acquired by querying an environment map based on the current position.

The environment map is a digital map displayed on a terminal. Each obstacle in the current environment is digitally marked in the environment map with a digital region occupied by the obstacle and the obstacle type in the digital region. A position in the environment map has a mapping relationship with a position measured in the actual environment. For a position in the actual environment, there is a corresponding position in the environment map. For example, an actual region occupied by walls and furnishings in a room is marked in the environment map with a digital region occupied by walls and furnishings; and an actual region occupied by a temporarily placed item (such as a flowerpot) is marked in the environment map with a digital region occupied by the temporarily placed item.

There is a corresponding position in the environment map for the current position of the current obstacle. If the corresponding position is in a digital region, this digital region is a marked region in the environment map after identifying the obstacle last time by the walking robot, and the marked obstacle type may be acquired through the digital region.

In step S102-13, bypassing to the at least one position around the obstacle is performed, when the marked obstacle type does not match with a current obstacle type.

The marked obstacle type not matching with the current obstacle type indicates two possibilities: one is that the last identification result may be wrong, that is, the last identification result may be misidentification; and the other is that the obstacle type marked in the first digital region corresponding to the current position is not the same as the current obstacle type, that is, the obstacle at the current position may have changed from the obstacle identified last time, and is not the same type of obstacle. This indicates that misidentification may exist as the current identification result is different from a result marked in the environment map after the last identification.

Second Judgment Method

Bypassing to the at least one position around the obstacle when the current identification feature information does not satisfy the identification condition includes the following steps.

In step S102-21, bypassing to the at least one position around the obstacle is performed when a confidence value of the current obstacle type is less than a preset confidence threshold.

The confidence value of the current obstacle type being less than the preset confidence threshold indicates that the current identification is in doubt.

In order to determine the obstacle type of the current obstacle, the reliability of acquiring a target type of the current obstacle is improved. In the embodiment of the present disclosure, the walking robot is controlled to bypass the current obstacle, a plurality of pieces of identification feature information of the current obstacle at the plurality of positions and from the plurality of angles is acquired, and the target type of the current obstacle is determined through the plurality of pieces of identification feature information.

In step S103, the target type of the obstacle is determined based on all identification feature information of the obstacle.

Due to the influence of environmental factors, after information of the obstacle at each position and from each angle is identified, the acquired obstacle types may be different, which affects the confirmation of the target type of the current obstacle. Therefore, in the embodiment of the present disclosure, the target type of the current obstacle is acquired by comprehensively analyzing the all identification feature information of the current obstacle.

Specifically, the following steps are included.

In step S103-11, a statistical value of each obstacle type is acquired by performing classification statistics on all obstacle types of the obstacle.

In the embodiment of the present disclosure, the statistical value of each obstacle type is acquired by performing classification statistics on all obstacle types. For example, the obstacle types include the cactus type and the lotus root type, the statistical value of the obstacle type being the cactus type is 18, and the statistical value of the obstacle type being the lotus root type is 2.

In S103-12, the obstacle type corresponding to the maximum statistical value is determined as the target type.

For example, continuing the example above, as the statistical value of the obstacle type being the cactus type is 18, i.e., the maximum statistical value, the cactus type is determined as the target type of the current obstacle.

Further, in order to eliminate interference of ineffective data, determining the target type of the obstacle based on the all identification feature information of the obstacle includes the following steps.

In step S103-21, a first obstacle type with the confidence value greater than or equal to the preset confidence threshold is acquired by screening all confidence values of the obstacle.

By the confidence value being greater than or equal to the preset confidence threshold, the obstacle types with low reliability are eliminated, and the first obstacle type with high reliability is acquired.

In step S103-22, a statistical value of each first obstacle type is acquired by performing classification statistics on all first obstacle types.

In the embodiment of the present disclosure, the statistical value of each obstacle type is acquired by performing classification statistics on all first obstacle types with high reliability. For example, the obstacle types include the cactus type and the lotus root type, the statistical value of the obstacle type being the cactus type is 18, and the statistical value of the obstacle type being the lotus root type is 2.

In step S103-23, the first obstacle type corresponding to the maximum statistical value is determined as the target type.

For example, continuing the example above, as the statistical value of the obstacle type being the cactus type is 18, i.e., the maximum statistical value, the cactus type is determined as the target type of the current obstacle.

Optionally, after the target type of the obstacle is determined, the following step is further included.

In step S104, the marked obstacle type is determined as misidentification information when the marked obstacle type does not match with the current obstacle type.

In order to keep actual information identical with digital information in the environment map, actual region information of the obstacle is collected when the obstacle is bypassed.

Optionally, after the marked obstacle type is determined as misidentification information, the following step is further included.

In S105, the target type and the actual region information are transmitted to the environment map.

Thus, a digital region corresponding to the actual region information is drawn in the environment map and the obstacle type of the obstacle is marked in the digital region.

In the embodiment of the present disclosure, the obstacle is identified; the obstacle is bypassed when the identification feature information does not satisfy the identification condition, and identification feature information of the current obstacle at a plurality of positions is continued to be collected; and the target type of the obstacle is determined based on all identification feature information. Thus, the misidentification rate is reduced and the identification reliability is improved, thereby avoiding misjudgment or judgment failure. Corresponding to the first embodiment provided by the present disclosure, the present disclosure further provides a second embodiment, i.e., an apparatus for identifying an obstacle. As the second embodiment is basically similar to the first embodiment, the second embodiment is described relatively simply. For related parts, reference may be made to the corresponding description of the first embodiment. The apparatus embodiment described below is merely exemplary.

Figure 3:
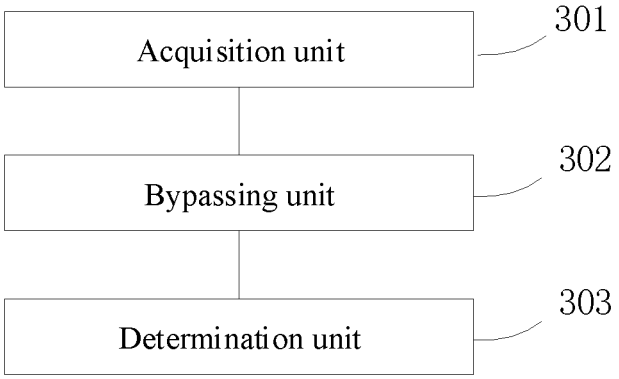
FIG. 3 shows a unit block diagram of an apparatus for identifying an obstacle according to an embodiment of the present disclosure.

FIG. 3 shows an embodiment of an apparatus for identifying an obstacle provided by the present disclosure.

As shown in FIG. 3, the present disclosure provides an apparatus for identifying an obstacle. The apparatus includes:

an acquisition unit 301 configured to acquire current identification feature information of the obstacle in a process of identifying the obstacle;

a bypassing unit 302 configured to bypass to at least one position around the obstacle when the current identification feature information does not satisfy an identification condition, and acquire identification feature information of the obstacle at each position correspondingly; and a determination unit 303 configured to determine a target type of the obstacle based on all identification feature information of the obstacle.

Optionally, the identification feature information at least includes an obstacle type.

The bypassing unit 302 includes:

a current position acquisition sub-unit configured to acquire a current position of the obstacle;

a query sub-unit configured to acquire a marked obstacle type corresponding to the current position by querying an environment map based on the current position; and a first bypassing sub-unit configured to bypass to the at least one position around the obstacle when the marked obstacle type does not match with a current obstacle type.

Optionally, the identification feature information further includes a confidence value of the obstacle type.

The bypassing unit 302 includes:

a second bypassing sub-unit configured to bypass to the at least one position around the obstacle when a confidence value of the current obstacle type is less than a preset confidence threshold.

Optionally, the determination unit 303 includes:

a first statistical sub-unit configured to acquire a statistical value of each obstacle type by performing classification statistics on all obstacle types of the obstacle; and a first target type determination sub-unit configured to determine the obstacle type corresponding to the maximum statistical value as the target type.

Optionally, the determination unit 303 includes:

a screening sub-unit configured to acquire a first obstacle type with the confidence value greater than or equal to the preset confidence threshold by screening all confidence values of the obstacle;

a second statistical sub-unit configured to acquire a statistical value of each first obstacle type by performing classification statistics on all first obstacle types; and a second target type determination sub-unit configured to determine the first obstacle type corresponding to the maximum statistical value as the target type.

Optionally, the apparatus further includes:

a marking unit configured to determine the marked obstacle type as misidentification information when the marked obstacle type does not match with the current obstacle type.

Optionally, the apparatus further includes:

a region information collection unit configured to collect actual region information of the obstacle when the obstacle is bypassed; and a transmission unit configured to transmit the target type and the actual region information to the environment map after the marked obstacle type is determined as the misidentification information.

In the embodiment of the present disclosure, the obstacle is identified; the obstacle is bypassed when the identification feature information does not satisfy the identification condition, and identification feature information of the current obstacle at a plurality of positions is continued to be collected; and the target type of the obstacle is determined based on all identification feature information. Thus, the misidentification rate is reduced, and the identification reliability is improved, thereby avoiding misjudgment or judgment failure.

A third embodiment of the present disclosure provides an electronic device, used for a method for identifying an obstacle. The electronic device includes at least one processor, and a memory in communication connection with the at least one processor.

The memory stores with instructions executable by the at least one processor, the instructions are executed by the at least one processor to cause the at least one processor to execute the method for identifying an Obstacle according to the first embodiment.

A fourth embodiment of the present disclosure provides a computer storage medium for identifying an obstacle. The computer storage medium stores with computer-executable instructions which can implement the method for identifying an obstacle according to the first embodiment.

Figure 4:
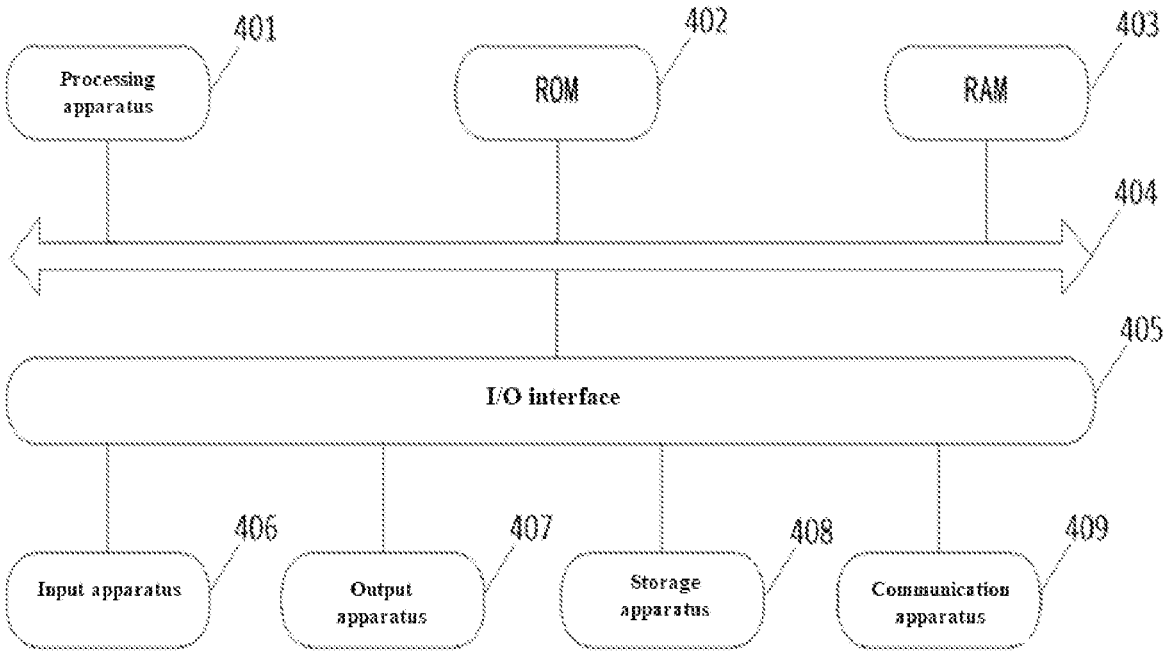
FIG. 4 shows a schematic diagram of a connection structure of an electronic device according to an embodiment the present disclosure.

Referring to FIG. 4, it shows a schematic structural diagram of an electronic device suitable for realizing an embodiment of the present disclosure. The electronic device of the present disclosure may include, but is not limited to, a mobile terminal such as a mobile phone, a notebook computer, a digital broadcast receiver, a personal digital assistant (PDA), a. PAD (tablet computer), a portable multimedia player (PMP), an onboard terminal (for example, an onboard navigation terminal) and the like, or a fixed terminal such as a digital TV, a desk computer and the like. The electronic device shown in FIG. 4 is only an example, and is not intended to limit the function and application range of the embodiments of the present disclosure.

As shown in FIG. 4, the electronic device may include a processing apparatus 401 (e.g., a central processing unit, a graphics processing unit or the like) which can execute various proper actions and processing according to programs stored in a read-only memory (ROM) or programs loaded into a random-access memory (RAM) 403 from a storage apparatus 408. Various programs and data required for operation of the electronic device are also stored in the RAM 403. The processing apparatus 401, the ROM 402 and the RAM 403 are connected with each other by a bus 404. An input/output (I/O) interface 405 is also connected to the bus 404.

Generally, the following apparatuses may be connected to the I/O interface 405: an input apparatus 406 including, for example, a touch screen, a touchpad, a keyboard, a mouse, a camera, a microphone, an accelerometer, a gyroscope and the like; an output apparatus 407 including, for example, a liquid crystal display (LCD), a speaker, a vibrator and the like; a storage apparatus 408 including, for example, a magnetic tape, a hard disk and the like; and a communication apparatus 409. The communication apparatus 409 can allow the electronic device to carry out wired or wireless communication with other devices so as to exchange data. Although FIG. 4 shows the electronic device with various apparatuses, it should be understood that all shown apparatuses are not required to be implemented or included. More or fewer apparatuses may be alternatively implemented or included.

Particularly, according to the embodiments of the present disclosure, the process described above with reference to the flow chart may be implemented as a computer software program. For example, a computer program product is provided according to an embodiment of the present disclosure, which includes a computer program carried on a non-transitory computer-readable medium, where the computer program includes a program code for executing the method shown in the flow chart. In such an embodiment, the computer program may be downloaded from the network by the communication apparatus 409 and installed, or installed from the storage apparatus 408, or installed from the ROM 402. When the computer program is executed by the processing apparatus 401, the above functions defined in the method according to the embodiment of the present disclosure are executed.

It should be noted that the above storage medium in the present disclosure may be a computer-readable signal medium or a computer-readable storage medium, or any combination of the two. The computer-readable storage medium may be, but not limited to, an electrical, magnetic, optical, electromagnetic, infrared, or semiconductor system, apparatus, or device, or a combination of any of the above. More specific examples of the computer-readable storage medium may include, but not limited to: an electrical connection with one or more wires, a portable computer disk, a hard disk, a random-access memory (RAM), a read-only memory (ROM), an erasable programmable read-only memory (EPROM or flash memory), optical fiber, a portable compact disk read-only memory (CD-ROM), an optical storage device, a magnetic storage device, or any suitable combination of the above. In the present disclosure, the computer-readable storage medium may be any tangible medium which includes or stores a program, and the program may be used by or in combination with an instruction execution system, apparatus, or device. In the present disclosure, the computer-readable signal medium may include a data signal propagated in a baseband or as part of a carrier wave, and a computer-readable program code is carried therein. This propagated data signal may be in many forms, including but not limited to an electromagnetic signal, an optical signal, or any suitable combination of the above. The computer-readable signal medium may also be any computer-readable medium other than the computer-readable storage medium, and the computer-readable signal medium may send, propagate, or transmit the program for use by or in combination with the instruction execution system, apparatus, or device. The program code included on the storage medium may be transmitted by any suitable medium, including, but not limited to: a wire, an optical cable, RF (radio frequency), etc., or any suitable combination of the above.

In some embodiments, the client and the server can communicate with each other by using any currently known or future-developed network protocol, for example, an HTTP (Hyper Text Transfer Protocol), and can be interconnected with digital data communication of any form or any medium (for example, a communication network). Examples of the communication network include a local region network (LAN), a wide region network (WAN), an internet network (for example, the Internet), and an end-to-end network (for example, an ad hoc end-to-end network), and any currently known or future-developed network.

The above computer-readable storage medium may be included in the above electronic device, or may exist alone without being assembled into the electronic device.

The computer program code for executing the operations of the present disclosure may be written in one or more programming languages or a combination thereof. The above programming languages include, but not limited to, object-oriented programming languages, such as Java, Smalltalk and C++, and further include conventional procedural programming languages, such as "C" language or similar programming languages. The program code may be executed entirely on a user computer, partly on the user computer, as an independent software package, partly on the user computer and partly on a remote computer, or entirely on a remote computer or a server. In the case of relating a remote computer, the remote computer may be connected to the user computer through any type of network, including the LAN or WAN, or may be connected to an external computer (for example, may be connected through the Internet using an Internet service provider).

The flowcharts and block diagrams in the accompanying drawings of the present disclosure show the possible architecture, functions, and operations of the system, the method, and the computer program product to be implemented according to various embodiments of the present disclosure. In this regard, each block in the flowcharts or block diagrams can represent a module, a program segment or a part of codes, and the module, the program segment or the part of the codes includes one or more executable instructions for implementing the defined logical functions. It should also be noted that in some implementations as alternatives, the functions labeled in the blocks can occur in an order different from the order labeled in the accompanying drawings. For example, two sequentially shown blocks can be substantially executed in parallel in fact, and they sometimes can also be executed in a reverse order, depending on related functions. It should also be noted that each block in the block diagrams and/or the flowcharts and the combination of the blocks in the block diagrams and/or the flowcharts can be implemented by a dedicated system based on hardware for executing defined functions or operations, or can be implemented by a combination of the dedicated hardware and computer instructions.

The units described in the embodiments of the present disclosure may be implemented in a software fashion or may be implemented in a hardware fashion. The names of the units do not constitute a limitation to the units in some cases.

The functions described above herein may be performed, at least in part, by one or more hardware logic components. For example, non-restrictively, exemplary types of hardware logic components that can be used include: a field programmable gate array (FPGA), an application-specific integrated circuit (ASIC), an application-specific standard product (ASSP), a system on chip (SOC), a complex programmable logic device (CPLD), and the like.

In the context of the present disclosure, a machine-readable medium may be a tangible medium that may include or store a program for use by or in combination with an instruction execution system, apparatus or device. The machine-readable medium may be a machine-readable signal medium or a machine-readable storage medium. The machine-readable medium may include, but not limited to, an electronic, magnetic, optical, electromagnetic, infrared or semiconductor system, apparatus or device, or any suitable combination of the foregoing. More specific examples of the machine-readable storage medium include an electrical connection based on one or more wires, a portable computer disk, a hard disk, a random-access memory (RAM), a read-only memory (ROM), an erasable programmable read-only memory (an EPROM or a flash memory), an optical fiber, a portable compact disk read-only memory (CD-ROM), an optical storage device, a magnetic storage device, or any suitable combination of the above content.

Compared with the related art, the above solutions of the embodiments of the present disclosure have at least the following benefits.

The present disclosure provides a method and apparatus for identifying the obstacle, a medium and an electronic device. In the present disclosure, the obstacle is identified; the obstacle is bypassed if the identification feature information does not satisfy the identification condition, and identification feature information of the current obstacle at multiple positions is continuously collected; and the target type of the obstacle is determined based on all the identification feature information. Thus, the misidentification rate is reduced, and the identification reliability is improved, thereby avoiding misjudgment or judgment failure.

The foregoing description is only the description of preferred embodiments of the present disclosure and the used technical principle. Those skilled in the art should understand that the scope of the present disclosure in the present disclosure is not limited to a technical solution formed by a specific combination of the technical features. In addition, other technical solutions formed by any combination of the foregoing technical features or equivalent features thereof shall be covered without departing from the concept of the present disclosure. For example, the technical solutions formed by mutual replacement between the foregoing features and the technical features having similar functions (however, the technical features are not limited thereto) disclosed in the present disclosure shall be encompassed.

Furthermore, although a specific order is used to depict the operations, this should not be interpreted that these operations are required to be performed in the specific order shown or in sequential order of execution. Multitasking and parallel processing may be advantageous in particular environments. In addition, while several specific implementation details are included in the above discussion, these should not be construed as a limit to the scope of the present disclosure. Some features described in the context of separate embodiments may also be implemented in combination in a single embodiment. Conversely, various features described in the context of a single embodiment may also be implemented in multiple embodiments individually or in any suitable sub-combination.

Although the present subject matter has been described using language specific to structural features and/or method logical actions, it should be understood that the subject matter defined in the appended claims is not necessarily limited to the particular features or actions described above. Rather, the particular features and actions described above are merely exemplary forms of implementing the claims.

What is claimed is:

1. A method for identifying an obstacle, comprising:

acquiring first identification feature information of the obstacle at a first position around the obstacle;

bypassing to at least one second position around the obstacle in response to determining that the first identification feature information does not satisfy an identification condition, and acquiring second identification feature information of the obstacle at a second position correspondingly; and determining a target type of the obstacle based on the first identification feature information and the second identification feature information of the obstacle;

wherein the first identification feature information at least comprises an obstacle type; and bypassing to the at least one second position around the obstacle in response to determining that the first identification feature information does not satisfy the Identification condition comprises:

acquiring a current position of the obstacle at the first position around the obstacle;

acquiring a marked obstacle type corresponding to the current position by querying an environment map based on the current position, and bypassing to the at least one second position around the obstacle in response to determining that the marked obstacle type does not match with the obstacle type.

2. The method according to claim 1, wherein, the first identification feature information further comprises a confidence value of the obstacle type; and bypassing to the at least one second position around the obstacle in response to determining that the first identification feature information does not satisfy the identification condition further comprises:

bypassing to the at least one second position around the obstacle in response to determining that the confidence value of the obstacle type is less than a preset confidence threshold.

3. The method according to claim 1, wherein determining the target type of the obstacle based on the first identification feature information and the second identification feature information of the obstacle comprises:

acquiring a statistical value of an obstacle type by performing classification statistics on the obstacle type in the first identification feature information and an obstacle type in the second identification feature information of the obstacle; and determining an obstacle type corresponding to a maximum statistical value as the target type.

4. The method according to claim 2, wherein the second identification feature information further comprises a confidence value of an obstacle type, and determining the target type of the obstacle based on the first identification feature information and the second identification feature information of the obstacle comprises:

acquiring an obstacle type with a confidence value greater than or equal to the preset confidence threshold by screening the confidence value in the first identification feature information and the confidence value in the second identification feature information of the obstacle;

acquiring a statistical value of the obstacle type by performing classification statistics on the obstacle type; and determining an obstacle type corresponding to a maximum statistical value as the target type.

5. The method according to claim 1, wherein the method further comprises:

determining the marked obstacle type as misidentification information in response to determining that the marked obstacle type does not match with the obstacle type.

6. The method according to claim 5, further comprising:

collecting actual region information of the obstacle when the obstacle is bypassed; and transmitting the target type and the actual region information to the environment map.

7. A non-transitory computer-readable storage medium, storing a computer program thereon, wherein the program, when executed by a processor, implements a method for identifying an obstacle, comprising:

acquiring first identification feature information of the obstacle at a first position around the obstacle;

bypassing to at least one second position around the obstacle in response to determining that the first identification feature information does not satisfy an identification condition, and acquiring second identification feature information of the obstacle at a second position correspondingly; and determining a target type of the obstacle based on the first identification feature information and the second identification feature information of the obstacle;

wherein the first identification feature information at least comprises an obstacle type; and bypassing to the at least one second position around the obstacle in response to determining that the first identification feature information does not satisfy the first identification condition comprises:

acquiring a current position of the obstacle at the first position around the obstacle;

acquiring a marked obstacle type corresponding to the current position by querying an environment map based on the current position; and bypassing to the at least one second position around the obstacle in response to determining that the marked obstacle type does not match with the obstacle type.

8. An electronic device, comprising:

one or more processors; and a storage apparatus, configured to store one or more programs, wherein the one or more programs, when executed by the one or more processors, enables the one or more processors to implement a method for identifying an obstacle, comprising:

acquiring first identification feature information of the obstacle at a first position around the obstacle;

bypassing to at least one second position around the obstacle in response to determining that the first identification feature information does not satisfy an identification condition, and acquiring second identification feature information of the obstacle at a second position correspondingly; and determining a target type of the obstacle based on the first identification feature information and the second identification feature information of the obstacle;

wherein the first identification feature information at least comprises an obstacle type; and bypassing to the at least one second position around the obstacle in response to determining that the first identification feature information does not satisfy the identification condition comprises:

acquiring a current position of the obstacle at the first position around the obstacle;

acquiring a marked obstacle type corresponding to the current position by querying an environment map based on the current position; and bypassing to the at least one second position around the obstacle in response to determining that the marked obstacle type does not match with the obstacle type.

9. The method according to claim 4, wherein the obstacle type is an identification result for the obstacle used to distinguish different obstacles, and the obstacle type comprises a name of the obstacle.

10. The method according to claim 4, wherein the confidence value is a judgement on reliability of the obstacle type and expressed as a percentage.

11. The method according to claim 1, wherein acquiring the second identification feature information of the obstacle at the second position correspondingly comprises:

acquiring identification feature information of the obstacle from a plurality of angles and at a plurality of positions around the obstacle.

12. The method according to claim 1, wherein the obstacle is digitally marked in the environment map with a digital region occupied by the obstacle and an obstacle type in the digital region.

13. The method according to claim 12, wherein there is a corresponding position in the environment map for the current position of the obstacle, and acquiring the marked obstacle type corresponding to the current position by querying the environment map based on the current position comprises:

acquiring the marked obstacle type through the digital region in response to determining that the corresponding position is in the digital region.

14. The electronic device according to claim 8, wherein, the first identification feature information further comprises a confidence value of the obstacle type; and bypassing to the at least one second position around the obstacle in response to determining that the first identification feature information does not satisfy the identification condition further comprises:

bypassing to the at least one second position around the obstacle in response to determining that the confidence value of the obstacle type is less than a preset confidence threshold.

15. The electronic device according to claim 8, wherein determining the target type of the obstacle based on the first identification feature information and the second identification feature information of the obstacle comprises:

acquiring a statistical value of an obstacle type by performing classification statistics on the obstacle type in the first identification feature information and an obstacle type in the second identification feature information of the obstacle; and determining an obstacle type corresponding to a maximum statistical value as the target type.

16. The electronic device according to claim 15, wherein the second identification feature information comprises a confidence value of an obstacle type, and determining the target type of the obstacle based on the first identification feature information and the second identification feature information of the obstacle comprises:

acquiring an obstacle type with a confidence value greater than or equal to the preset confidence threshold by screening the confidence value in the first identification feature information and the second confidence value in the second identification feature information of the obstacle;

acquiring a statistical value of the obstacle type by performing classification statistics on the obstacle type; and determining an obstacle type corresponding to a maximum statistical value as the target type.

17. The electronic device according to claim 8, wherein the method further comprises:

determining the marked obstacle type as misidentification information in response to determining that the marked obstacle type does not match with the obstacle type.

18. The electronic device according to claim 17, wherein the method further comprising:

collecting actual region information of the obstacle when the obstacle is bypassed; and transmitting the target type and the actual region information to the environment map.

* * * * *